US005634775A

United States Patent [19]

Murakami et al.

[11] Patent Number: 5,634,775

[45] Date of Patent: Jun. 3, 1997

[54] WAVE CAM TYPE COMPRESSOR

[75] Inventors: Kazuo Murakami; Masahiro Kawaguchi; Kunifumi Goto, all of Kariya, Japan

[73] Assignee: Kabushiki Kaisha Toyoda Jidoshokki Seiskusho, Kariya, Japan

[21] Appl. No.: 363,609

[22] Filed: Dec. 23, 1994

Related U.S. Application Data

[63] Continuation-in-part of Ser. No. 254,970, Jun. 7, 1994.

[30] Foreign Application Priority Data

Dec. 27, 1993 [JP] Japan ..... 5-331736

[51] Int. Cl.[6] ..... F04B 1/16

[52] U.S. Cl. ..... 417/269; 74/56; 91/502

[58] Field of Search ..... 417/269; 91/507; 92/71; 74/56

[56] References Cited

U.S. PATENT DOCUMENTS 4,432,310 2/1984 Waller ..... 417/269
4,756,239 7/1988 Hattori et al. .

FOREIGN PATENT DOCUMENTS 3022190 8/1982 Germany ..... 417/269
3613353 12/1986 Germany .
57-110783 7/1982 Japan .
62-121874 6/1987 Japan .
63-147571 9/1988 Japan .

*Primary Examiner*—Charles G. Freay
*Attorney, Agent, or Firm*—Brooks Haidt Haffner & Delahunty

[57] ABSTRACT

A wave cam type compressor is provided. The compressor has a wave cam body mounted on a rotary shaft for integral rotation and pistons operably contacting said cam body by way of shoes. The shoes are moveable relative to the cam body according to the rotation of the cam body. The shoes move on predetermined paths on cam surfaces of the cam body. The rotation therewith of the rotary shaft is converted into a reciprocation movement of the pistons between top dead center and a lower dead center in cylinder bores to compress fluid supplied into the cylinder bores. Each cam surface has a contour matching the locus of a predetermined smooth two-dimensional imaginary curve when the curve is translated from its plane in the direction perpendicular to the plane. A first portion is provided on the cam surface to drive the piston to the bottom dead center and a second portion is provided on the cam surface to drive the piston to the top dead center. The second portion has a greater radius of curvature than the first portion.

25 Claims, 8 Drawing Sheets

WAVE CAM TYPE COMPRESSOR

CROSS REFERENCE TO RELATED APPLICATION

This application is a continuation in part application of the U.S. patent application Ser. No. 08/254,970 filed Jun. 7, 1994, which is incorporated herein by reference.

BACKGROUND OF THE INVENTION

1. Background of the Invention

The present invention relates to a compressor. More particularly, it pertains to a wave cam type compressor having a wave cam body integrally rotatable with a rotary shaft about an axis thereof. The rotation and cam action of the plate are converted to the reciprocating movements of pistons, thus causing the compression of gas.

2. Description of the Related Art

In a swash plate type compressor, the double-headed piston performs one reciprocating movement in accordance with one complete rotation of the swash plate. More specifically, a movement diagram indicative of one rotation of the swash plate is represented by one cycle of a sine wave curve. Accordingly, one rotation of the shaft causes a piston head to compress the refrigerated gas only once. There has been a need for a swash plate-like compressor having an improved compression capacity for a single shaft rotation.

During recent years, a compressor replacing a swash plate with a cam body has been proposed. In this type of compressor, the rotation of the cam body is converted to the reciprocation of pistons. The plate has either cam surfaces or cam grooves on both sides thereof. A movement diagram indicating one rotation of the plate is represented by a sine wave curve having a plurality of cycles. Accordingly, one rotation of the shaft causes a piston head to compress the refrigerated gas several times. Therefore, compression capacity is improved at least twice as much as compared to the swash plate design.

The Japanese Unexamined. Patent Publication 57-110783 discloses a compressor having rollers interposed between both front and rear cam surfaces of a cam plate and both heads of a piston. Each of the rollers are rotatably and permanently fitted within the piston head. The rollers move relatively with respect to the cam surfaces when the plate rotates. The displacement of the cam surface is transmitted to the associated piston head via the rollers. This causes the piston to reciprocate in a cylinder bore based on the curve of the cam surface.

The Japanese Unexamined Utility Model Publication 63-147571 discloses a compressor having a cam body on which cam grooves are formed on its front and rear surfaces. Piston heads are coupled to the plate by way of balls interposed between the cam grooves and the piston heads.

In the above publications, both the rollers and the balls interposed between the cam plate and the piston move relatively with respect to the plate. In these constructions, the roller or ball is kept in a line of contact with the plate. However, in a microscopic view, the deformation of the contacting portions causes a planar contact area between the balls or rollers and the plate. This decreases the pressure per unit of area acting on the balls or rollers and the plate. This decrease in pressure is an important facter when considering the durability of the compressor.

A decrease in Hertz's contact pressure can be achieved by enlarging the planar contact portion. This can be achieved by increasing the length of the contact portion and/or decreasing the curvature of the contact portion (increasing the radius of curvature). In order to decrease the pressure acting on the roller and the plate, the length and/or the diameter of the roller is increased. In order to decrease the pressure acting on the ball and the plate, the diameter of the ball is increased. However, since the rollers or balls are fitted in the pistons, the length of the roller or the diameter of the ball is affected by the dimension of the piston. Therefore, it is necessary to enlarge the diameter of the piston in order to increase either the length of the roller or the diameter of the ball. This makes it necessary to provide a large size compressor. However, vehicle-mounted compressors are preferably compact and lightweight.

SUMMARY OF THE INVENTION

Accordingly, it is an object of the present invention to provide a wave cam type compressor which is kept compact and has a improved durability.

To achieve the above object, a wave cam type compressor is provided. The compressor has a wave cam body mounted on a rotary shaft for an integral rotation therewith and a piston operably contacting said cam body by way of a shoe. The shoe is relatively moveable relative to the cam body responsive to the rotation thereof. The shoe moves along a predetermined orbit on a cam surface provided on the cam body whereby the rotation of the rotary shaft is converted into a reciprocation movement of the piston between a top dead center and a bottom dead center in a cylinder bore to compress fluid supplied into the cylinder bore. The cam surface has a contour matching the locus of a predetermined smooth two-dimensional imaginary curve of finite length when translated from its plane in the direction perpendicular to said plane. A first portion of the cam surface is provided to drive the piston to the bottom dead center, and a second portion of the cam surface is provided to drive the piston to the top dead center, with the second portion having a larger radius of curvature than the first portion.

According to another aspect of the present invention, a compressor has a wave cam body having a first cam surface and a second cam surface respectively provided on opposite surfaces of the cam body and mounted on a rotary shaft for integral rotation therewith, a plurality of pairs of cylinder bores arranged around an imaginary circle centered about an axis of the rotary shaft, each of said pairs of bores consisting of two axially opposed cylinder bores, a plurality of pistons each having a pair of piston heads respectively accommodated in an associated pair of cylinder bores, and a plurality of pairs of shoes respectively coupled to the piston heads and relatively slidably moveable relative to the cam body according to the rotation thereof, wherein the shoes slide along predetermined orbits on each cam surface whereby the rotation of the rotary shaft is converted into a reciprocating movement of each piston between a top dead center and a bottom dead center in the associated cylinder bores to compress fluid supplied into the cylinder bores. Each cam surface has a contour matching the locus of a predetermined smooth two-dimensional imaginary curve of finite length when translated from its plane in the direction perpendicular to said plane, wherein the predetermined smooth curve is non-finite and has two straight lines at its ends each inclining with a predetermined angle, and an arc connecting the straight end lines. The cam surface further includes an outer peripheral edge defined by a first circle greater than and concentric with the imaginary circle and an inner peripheral edge defined by a second circle smaller than and concentric with the imaginary circle. The cylinder bores respectively include axes extending on the surface of an imaginary cylinder. Each predetermined orbit is axially and alternatingly convex and concave along a surface of said imaginary cylinder connecting the axes of the cylinder bores. The cam surface has a pair of advancing portions provided on each cam surface to advance the heads of each piston to the top dead center and a pair of retrieving portions provided on each cam surface to retrieve the heads of each piston to the bottom dead center, wherein said advancing portions have a larger radius of curvature than said retrieving portions. The predetermined orbits being axially aligned and equidistantly spaced throughout the entire area of the cam body.

BRIEF DESCRIPTION OF THE DRAWINGS

FIG. 5(*b*) is a schematic perspective view depicting a method for manufacturing the cam body;

FIG. 11(*b*) is a schematic side view illustrating an imaginary cylindrical surface connecting axes of cylinder bores, which crosses another cylindrical surface for defining a profile of the cam body.

DETAILED DESCRIPTION OF THE PREFERRED EMBODIMENT

A preferred embodiment of the present invention will now be explained with reference to FIGS. 1–9.

Figure 1:
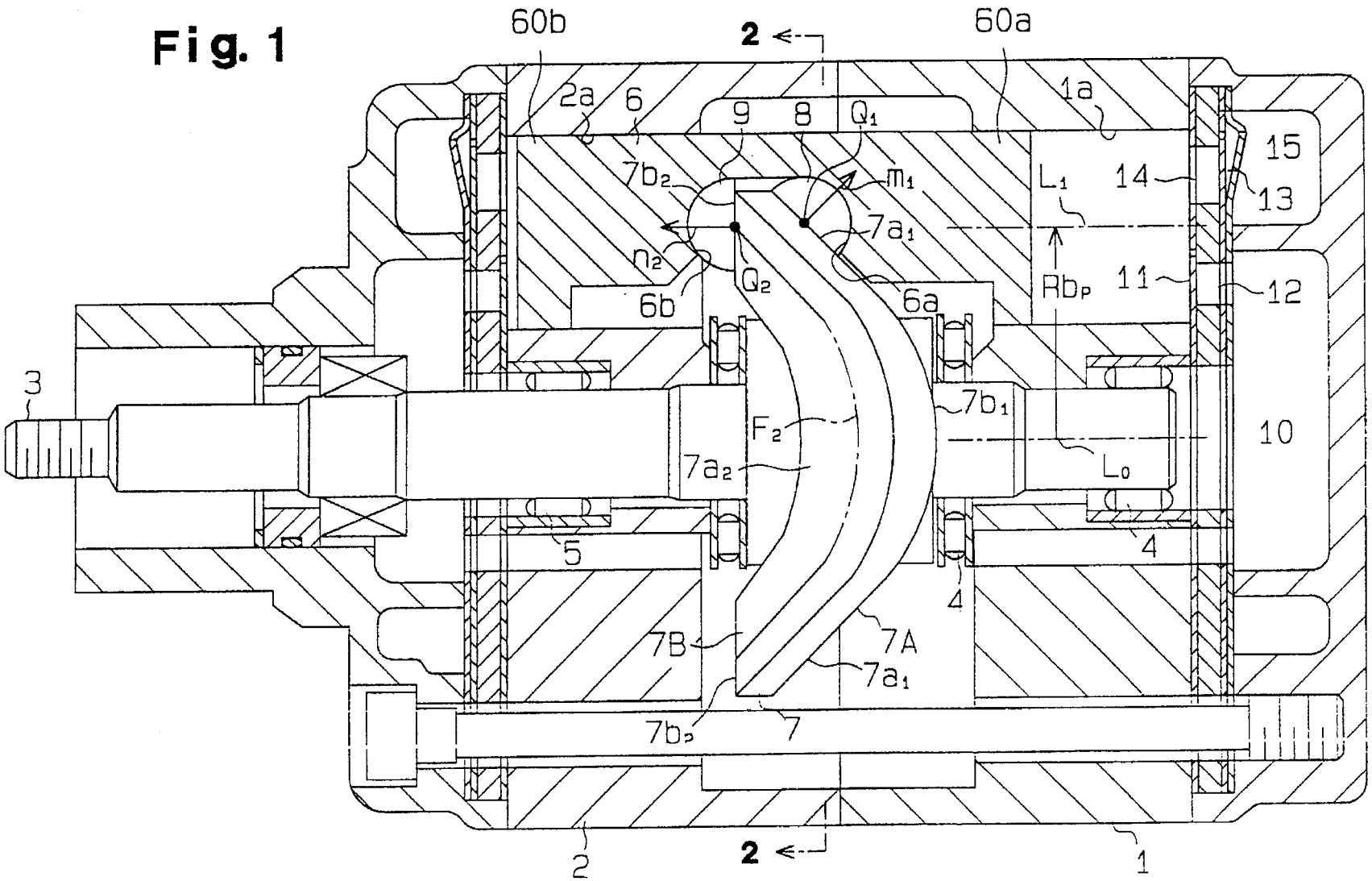
FIG. 1 is a cross sectional view illustrating a compressor according to the present invention.

Referring to FIG. 1, a pair of cylinder blocks 1, 2 are securely fastened to each other by bolts (not numbered). A rotary shaft 3 is rotatably supported within the blocks 1, 2 by radial bearings 4, 5. Cylinder blocks 1, 2 have longitudinally aligned pairs of cylinder bores 1*a*, 2*a* (5 pairs in this embodiment), the axes of which are positioned on the same circle at equal circular spacing. A center axis $L_1$ of each cylinder bore 1*a*, 2*a* is positioned on a phantom cylindrical surface $C_0$ (FIG. 2), the center of which coincides with an axis $L_0$ of the rotary shaft 3. All the pistons are identical, therefore only one is described. A piston 6 has a pair of opposed heads 60*a*, 60*b* slidably disposed within the cylinder bores 1*a*, 2*a*, respectively.

Figure 3:
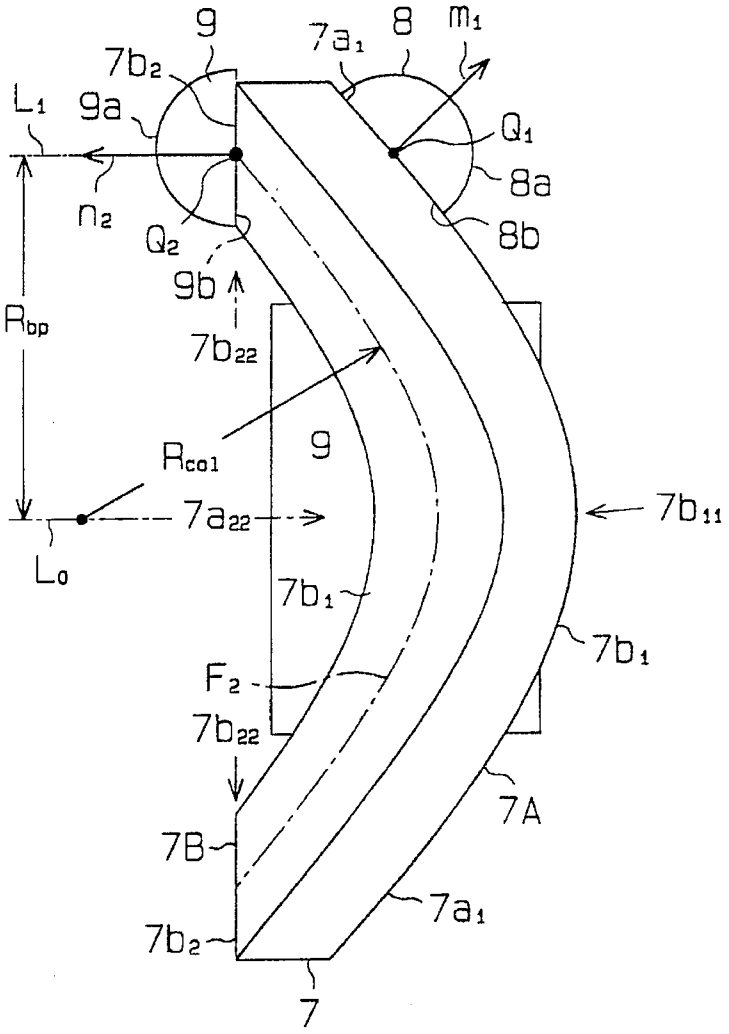
FIG. 3 is an enlarged side view illustrating a cam body used in the compressor.

A cam body 7 is integrally mounted on the rotary shaft 3. The cam body 7 has cam surfaces 7A, 7B on its rear (to the right in FIG. 1) and front surfaces, respectively. Shoes 8, 9 are interposed between the cam Surfaces 7A, 7B and the heads 60*a*, 60*b*, respectively. Each head 60*a*, 60*b* has a recess portion 6*a*, 6*b*, respectively, on its internal surface. Each of the shoes 8, 9 has spherical surfaces 8*a*, 9*a* and flat surfaces 8*b*, 9*b* (FIG. 3). The spherical surfaces 8*a*, 9*a* are received in the associated recess portion 6*a*, 6*b*. The flat surfaces 8*b*, 9*b* slide on the associated cam surfaces 7A, 7B. The shoes 8, 9 are fitted in recess portions 6*a*, 6*b* and thus coupled to the piston 6. Each radius center $Q_1$, $Q_2$ of the shoes 8, 9 is at the center of the flat surfaces 8*b*, 9*b*.

The first and second cam surfaces 7A, 7B have movement curve lines $F_1$, $F_2$ for determining the reciprocation cycle of the piston 6. Each of the lines $F_1$, $F_2$ alternately curves axially forward and rearward on the cylindrical surface $C_0$. The radius centers $Q_1$, $Q_2$ of the shoes 8, 9 move along the movement curve lines $F_1$, $F_2$ for the radius centers $Q_1$, $Q_2$ are at the center of the flat surfaces 8*b*, 9*b*.

Figure 2:
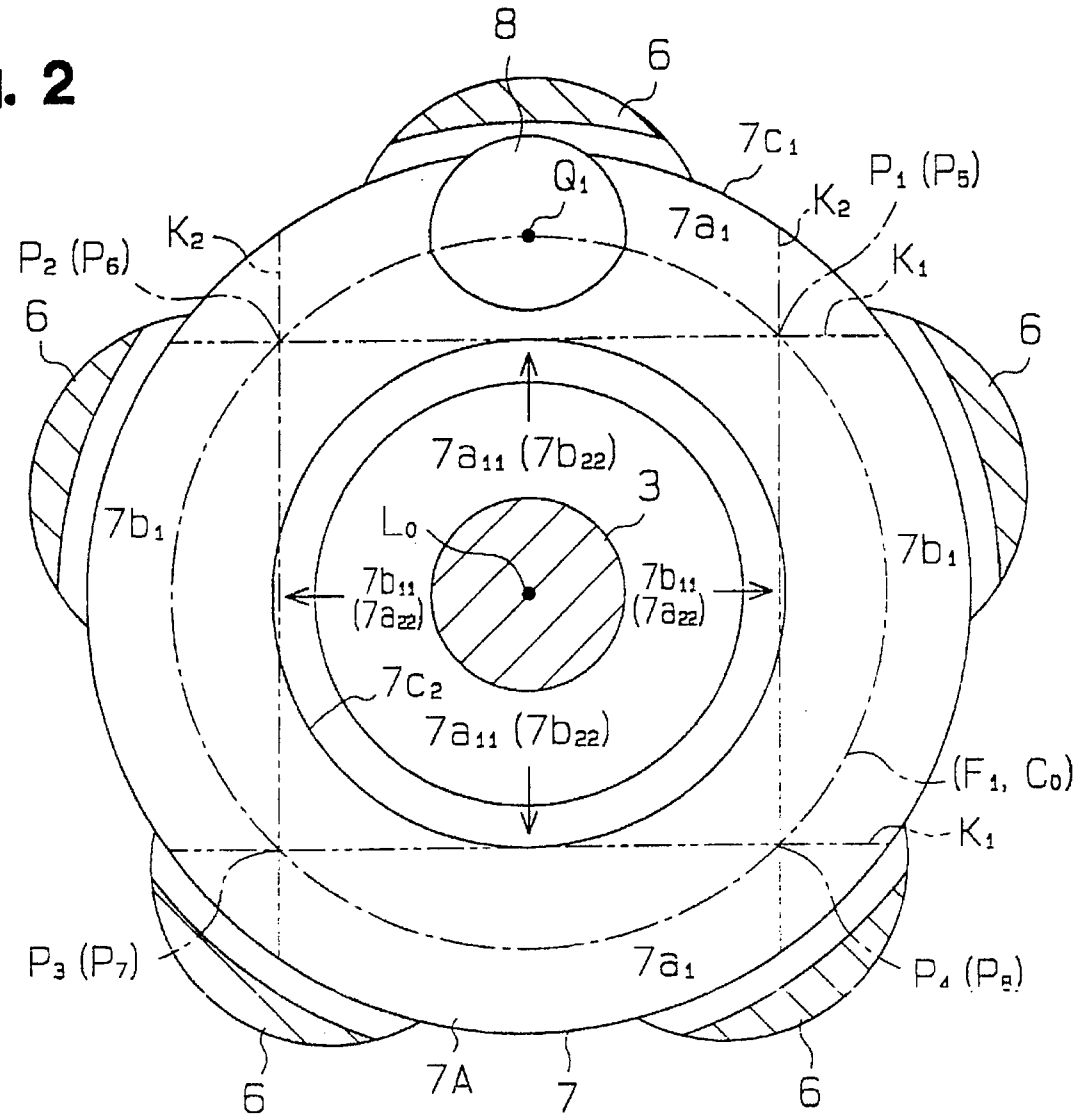
FIG. 2 is a cross sectional view illustrating the compressor along line 2—2 of FIG. 1.
Figure 5A:
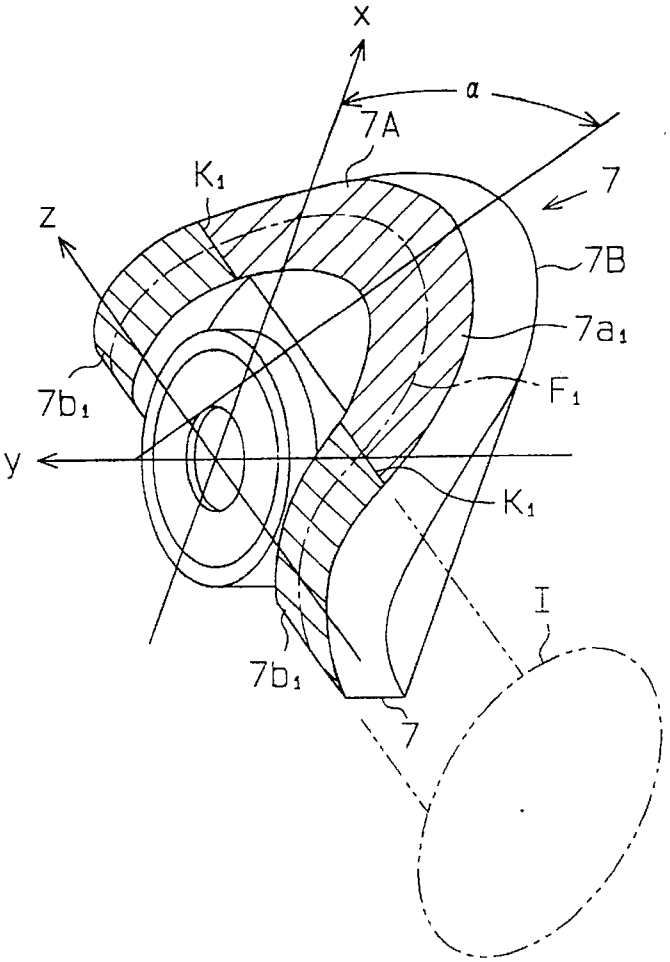
FIG. 5(*a*) is a perspective view illustrating the cam body.
Figure 5B:
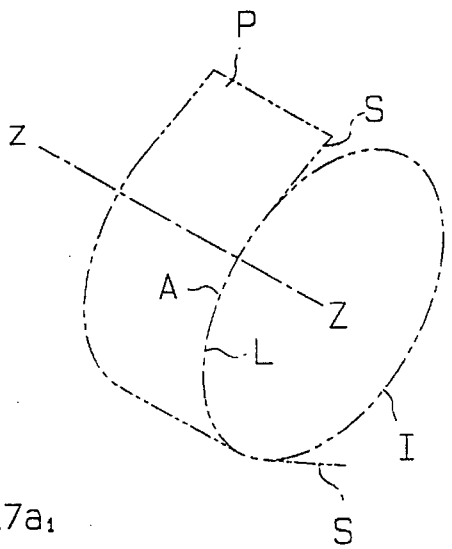

Referring to FIGS. 2 and 5, the first cam surface 7A includes a pair of curved surfaces $7b_1$ and a pair of flat surfaces $7a_1$. Each of the curved surfaces $7b_1$ is a part of a phantom cylinder, the axis of which is perpendicular to and intersects with the axis of the rotary shaft 3. The flat surfaces $7a_1$ are formed to be continuous with the curved surfaces $7b_1$. The phantom straight lines $K_1$ represent the lines of intersection between the surfaces $7a_1$, $7b_1$. The two lines $K_1$ perpendicularly cross with the cylindrical surface $C_0$ at four points $P_1$, $P_2$, $P_3$, $P_4$. Accordingly, the movement curve line $F_1$ of 7A is divided into four portions at equal intervals of 90° along the cam surface 7A. The flat surface 7*a*1 is inclined at an angle of 45° to the axis $L_0$ of the rotary shaft 3. A normal vector $m_1$ to the flat surface $7a_1$ is steered away from the axis $L_0$ rearward in the compressor (to the right side in FIG. 1). A normal vector $n_1$ to the curved surface $7b_1$ is parallel to the axis $L_0$ and steered forward (to the left side in FIG. 1).

The second cam surface 7B includes a pair of curved surfaces $7b_2$ and a pair of flat surfaces $7a_2$. Each of the curved surfaces $7b_3$ is a part of an imaginary cylinder, the axis of which is perpendicular to and intersects with the axis of the rotary shaft 3. The flat surfaces $7a_2$ are formed to be continuous with the curved surfaces $7b_2$. The phantom straight lines $K_1$ represent the lines of intersection between the surfaces $7a_2$, $7b_2$. The two lines K2 perpendicularly cross with the cylindrical surface $C_0$ at four points $P_5$, $P_6$, $P_7$, $P_8$. Accordingly, the movement curve line $F_2$ of 7B is divided four portions at equal intervals of 90° along the cam surface 7B. The flat surface $7a_2$ is inclined at an angle of 45° to the axis $L_0$ of the rotary shaft 3. A normal vector $m_2$ to the flat surface $7a_2$ is steered away from the axis $L_0$ forward in the compressor. A normal vector $n_2$ to the curved surface $7b_2$ is parallel to the axis $L_0$ and steered rearward.

The points $P_1$, $P_2$, $P_3$, $P_4$ on the first cam surface 7A are axially aligned with the points $P_5$, $P_6$, $P_7$, $P_8$ respectively, on the second cam surface 7B. Each flat surface $7a_1$ axially corresponds with one of the curved surface $7b_2$ on the opposite side of the cam body 7. Similarly, each curved surface $7b_1$ axially corresponds with one of the flat surfaces $7a_2$ on the opposite side of the cam body 7. On the flat surface $7a_1$ of the first cam surface 7A, two low points $7a_{11}$ are separated from each other by 180°. On the curved surfaces $7b_1$, two high points $7b_{11}$ are provided between the two low points $7a_{11}$. On the flat surfaces $7a_2$ of the second cam surface 7B, two low points $7a_{22}$ are axially aligned with the high points $7b_{11}$. On the curved surface $7b_2$, two high points $7b_{22}$ are axially aligned with the low points $7a_{11}$.

A rotation of the cam body 7 causes the low points $7a_{11}$, $7a_{22}$ to drive the piston heads 60*a*, 60*b* to bottom dead centers within the cylinder bores 1*a*, 2*a*, respectively. The high points $7b_{11}$, $7b_{22}$ move the piston heads 60*a*, 60*b* to top dead centers within the cylinder bores 1*a*, 2*a*, respectively.

One complete rotation of the cam body 7 having the cam surfaces 7A, 7B will result in two reciprocation cycles of the piston 6 based on the movement curves $F_1$, $F_2$, respectively. The movement of the piston 6 causes a refrigerant gas within a suction chamber 10 to be drawn into the cylinder bores 1*a*, 2*a* via a suction valve 11 and a suction port 12. The further movement of the piston 6 discharges the refrigerant gas within the cylinder bores 1*a*, 2*a* into a discharge chamber 15 from a discharge port 14 and a discharge valve 13.

A constant distance between centers $Q_1$, $Q_2$ of the two spherical surfaces 8*a*, 9*a* needs to be maintained for the piston 6 to reciprocate smoothly, i.e. a constant axial distance between the movement curves $F_1$, $F_2$ must be maintained. The cam body 7 fulfills this requirement, denoted herein as requirement (J). Factors necessary to satisfy requirement (J) will now be explained. Referring to FIG. 5(*a*), a y axis corresponds to the axis $L_O$, a z axis is parallel to the axis of the curved surface $7b_1$, and an x axis is parallel to the axis of the curved surface $7b_2$. As shown in FIG. 5(*b*), an open cylindrical surface P of the cam surface 7A is determined by the locus of a curved line L when translated in a direction along the z axis. Surface P extends between a large circle $7C_1$ and small circle $7C_2$, both concentric to the cylinder $C_O$, to define the cam surface 7A in a projected sight (FIG. 2). In the present embodiment, the curve line L has two straight end lines both inclining with an angle |α|° to the x axis and connected to one another by an arc. The straight lines S define the planar surfaces $7a_1$ and the arc between them, which is part of an imaginary circle I, defines the curved surfaces $7b_1$. Similarly, a locus of an identical curved line as it is displaced along the x axis defines the shape of the opposite cam surface 7B.

Figure 6:
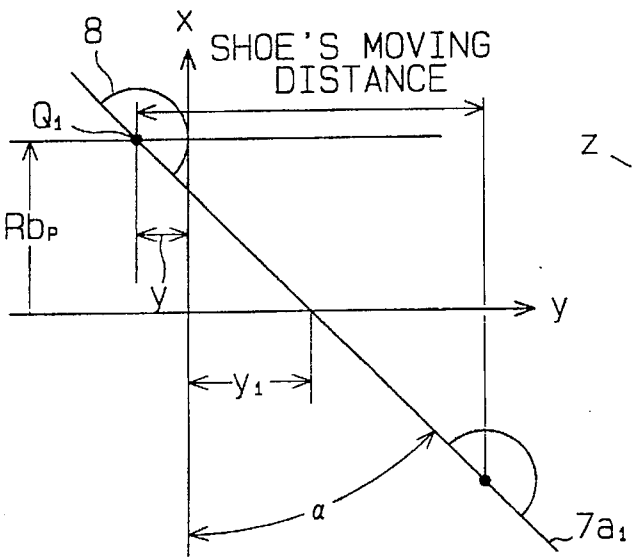
FIG. 6 is a graph depicting a movement curve on a flat surface of the cam body.

FIG. 5(*a*) shows the cam body 7 in the xyz coordinate system for better understanding. FIG. 6 shows a diagram which represents the displacement of the shoe 8 using the xy coordinate system. The displacement of the shoe 8 will be described referring to FIGS. 5(*a*) and 6.

A displacement amount y of the shoe 8 during the movement of the center $Q_1$ along the movement curve $F_1$, is represented by formula (1).

$$y=y_1+Rbp-\tan\alpha-\cos\theta \tag{1}$$

Referring to FIG. 6, $y_1$ is an intersection point of the plane $7a_1$ and y axis. Alpha (α) is the angle of plane $7a_1$ with respect to the x axis. Theta (θ) is an angle of rotation of the cam body 7 about the y axis. The rotation angle θ is 0° when the piston head 60*a* is at the top dead center. Rbp is the radius of the cylinder $C_O$.

Formula (1) is indicative of a cosine curve representing the movement curve $F_1$ along the plane of the surface $7a_1$ (or the movement curve $F_2$ along the plane $7a_2$). Therefore, to fulfill requirement (J), the movement curve $F_2$ along the curved surface $7b_2$ corresponding to plane $7a_1$, or $F_1$ along $7b_1$ must be indicative of a cosine curve represented by the next formula (2) where y (θ) represents the displacement of the shoe 9 (or 8).

$$y(\theta)=C_1+C_2-\cos\theta \tag{2}$$

$C_1$, $C_2$ are constant.

Figure 7:
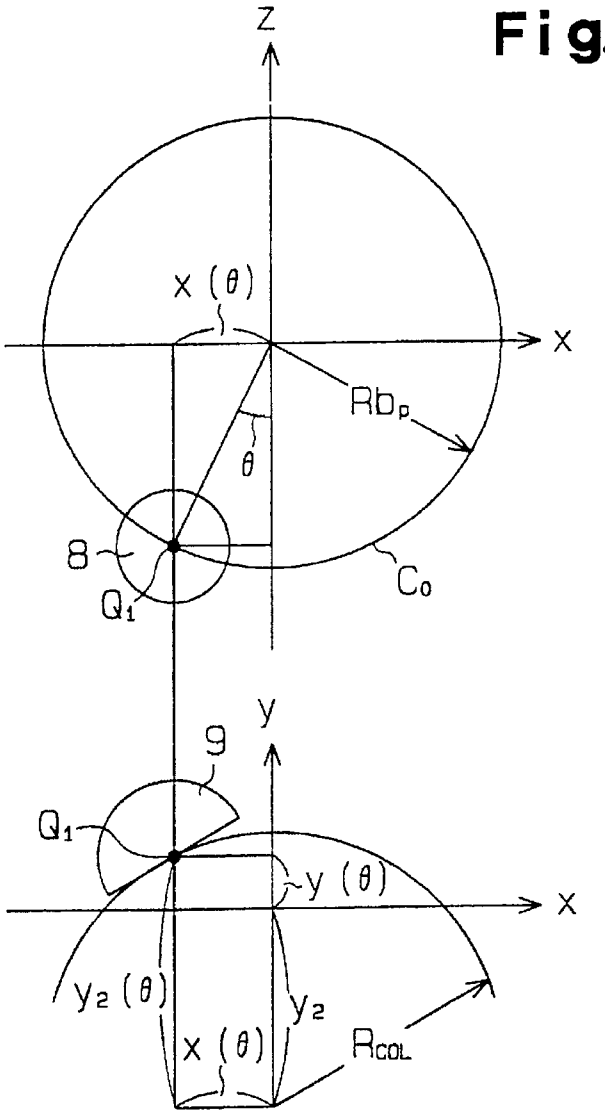
FIG. 7 is a graph depicting a movement curve on a curved surface of the cam body.

Formula (3) is indicative of a displacement amount y (θ) of the shoe 9 along the curve F2 (or the shoe 8 along the curve $F_1$), wherein $R_{co1}$ denotes the radius of curvature of the curved surface $7b_2$ (or $7b_1$) as shown in FIG. 7. Each variable or constant y (θ), $y_2$ (θ), $y_2$, x (θ) is defined as shown in FIG. 7.

$$y(\theta)=y_2(\theta)-y_2 \tag{3}$$

Formula (4) is indicative of $y_2$ (θ)

$$y_2(\theta)^2+x(\theta)^2=R_{col}^2 \tag{4}$$

$$\begin{aligned} y_2(\theta) &= [R_{col}^2-x(\theta)^2]^{1/2} \\ &= [R_{col}^2-Rbp^2\cdot\sin^2\theta]^{1/2} \end{aligned}$$

Formula (2) can be changed to the next formula (5).

$$y(\theta)=C_1+C_2-(1-\sin^2\theta)^{1/2} \tag{5}$$

To fulfill requirement (J), the constants concerning formula (4) and formula (5) can be established from the next formula (6).

$$R_{co1}=Rbp=C_2 \tag{6}$$

Therefore, formula (7) derives from formulas (1), (5), (6).

$$Rbp=Rbp.\tan\alpha \tag{7}$$

$$\tan\alpha=1,\ \alpha=45°$$

The inclination angle of plane $7a_1$ to the axis $L_O$ is 45°, as understood in formula (7) to fulfill the above-mentioned requirement (J). Furthermore, the elements of the curved surface $7b_2$ needs to be perpendicular to axis $L_O$ and the radius $R_{co1}$ equal to the radius Rbp of the cylindrical surface $C_O$. When the same conditions are fulfilled for the flat surface $7a_2$ and the curved surface $7b_1$, the above-mentioned requirement (J) becomes effective.

Figure 9:
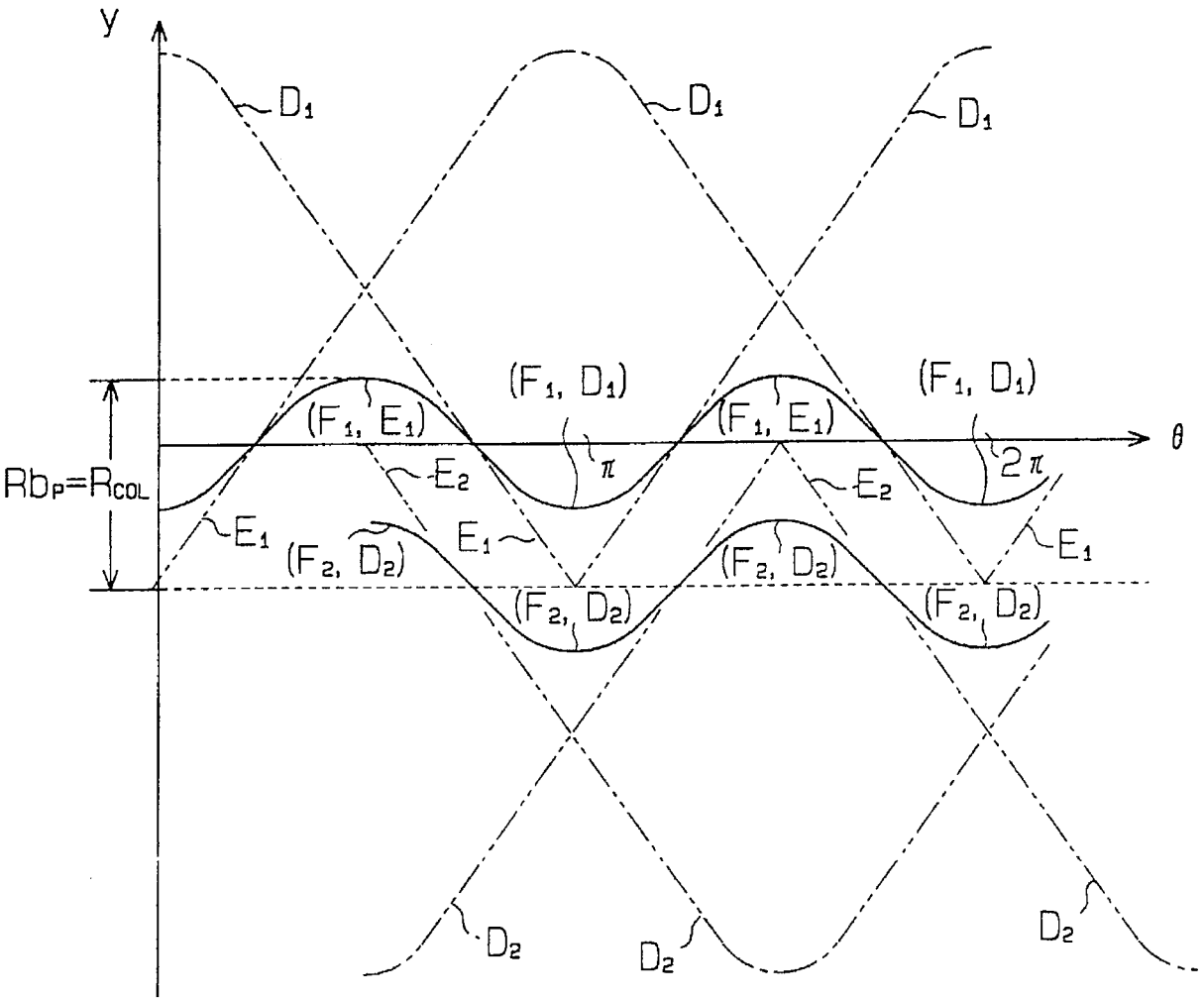
FIG. 9 is a graph depicting a requirement (J) for keeping two shoes equidistant on both sides of the cam body.

FIG. 9 shows a diagram which shows the movement curves $F_1$, $F_2$ when the requirement (J) is fulfilled. A curve line $D_1$ is indicative of the movement curve $F_1$ on the flat surface $7a_1$. A curved line $E_1$ is indicative of the movement curve $F_1$ on the curved surface $7b_1$. A curved line $D_2$ is indicative of the movement curve $F_2$ on the flat surface $7a_2$. A curved line $E_2$ is indicative of the movement curve $F_2$ on the curved surface 7*b*2. The phases of both movement curve lines $F_1$, $F_2$ are separated by π/2. Referring to FIG. 9, the axial distance between the movement curves $F_1$, $F_2$ is kept constant along the entire circumference of the cam body 7.

Figure 4:
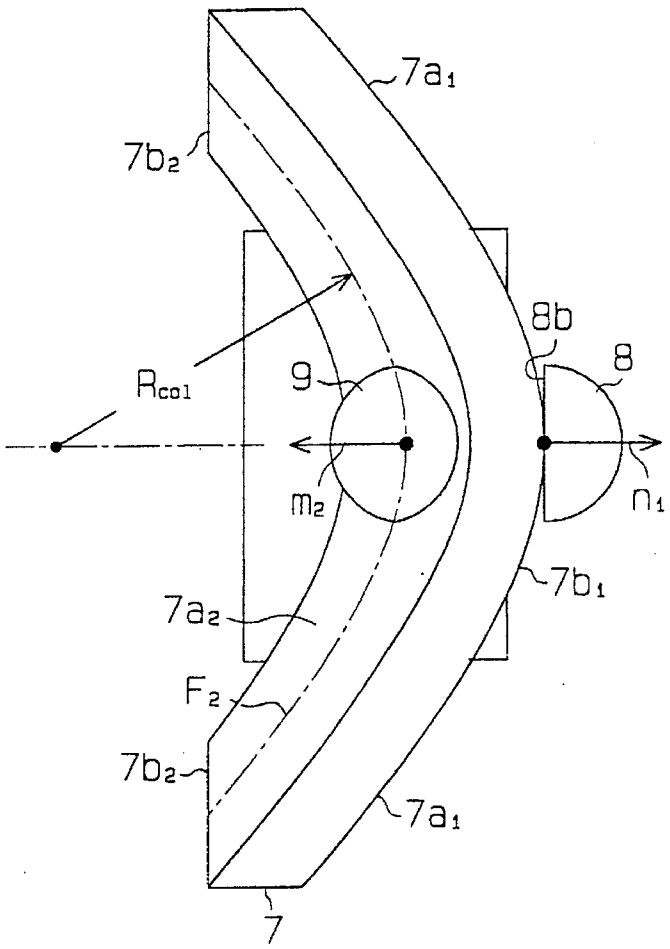
FIG. 4 is an enlarged plan view illustrating the cam body.

As shown in FIGS. 3 and 4, the cam body 7 which fulfills the requirement (J), allows the flat surfaces 8*b*, 9*b* of the shoes 8, 9 and the flat surfaces $7a_1$, $7a_2$ to be in planar contact. The cam body 7 permits the surfaces 8*b*, 9*b* and the surfaces $7b_1$, $7b_2$, to be in linear contact. FIG. 4 is a plan view of the cam body 7 rotated 90° with respect to the plate shown in FIG. 3. The above planar contact minimizes the Hertz's contact pressure between the shoes 8, 9 and the cam body 7. In this embodiment, the shoes 8, 9 slide on the flat surfaces $7a_1$, $7a_2$, respectively, for about one half of the rotation of the cam body 7. Therefore, the Hertz's contact pressure is minimized for half of the time the compressor is in operation. This provides the shoes 8, 9 and the cam body 7 with resistance to wear. Accordingly, the durability of the compressor is improved.

Figure 8:
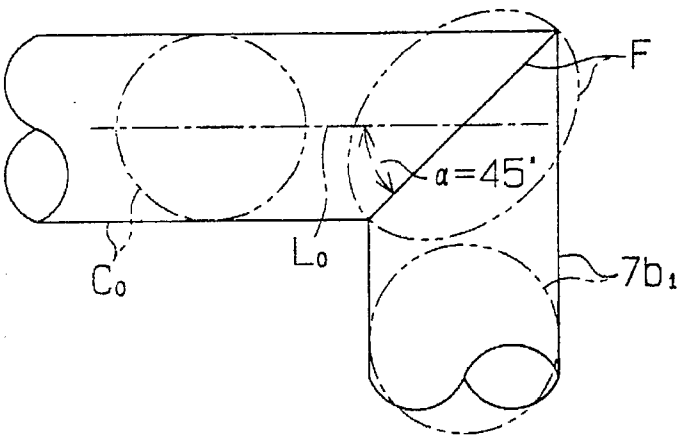
FIG. 8 is a schematic side view illustrating an imaginary cylindrical surface connecting axes of cylinder bores, the cylindrical surface crossing another cylindrical surface for defining a profile of the cam body.

FIG. 8 shows the imaginary cylindrical surface $C_0$ intersecting with the curved surface $7b_1$. If the cylindrical surface $C_0$ perpendicularly intersects with the curved surface $7b_1$, an intersecting curve F between the cylindrical surface $C_0$ and the curved surface $7b_1$ will be on a plane inclined with the angle $\alpha$ of 45° with respect to the axis L0. The curve F is indicative of an oval represented by the next formula (8).

$$x^2/\cos^2\alpha+y^2=Rbp^2 \quad (8)$$

A line of intersection between the cylindrical surface $C_0$ and the curved surface $7b_2$ is also defined by the same formula. The movement curve lines $F_1$, $F_2$ and parts of the intersecting curve F are congruent.

In the compressor according to the above embodiment, the cam surfaces 7A, 7B have convex surfaces which are 90 degrees out of phase one from another, resulting in an improved strength in comparison with the conventional plate actuating the piston.

Figure 10:
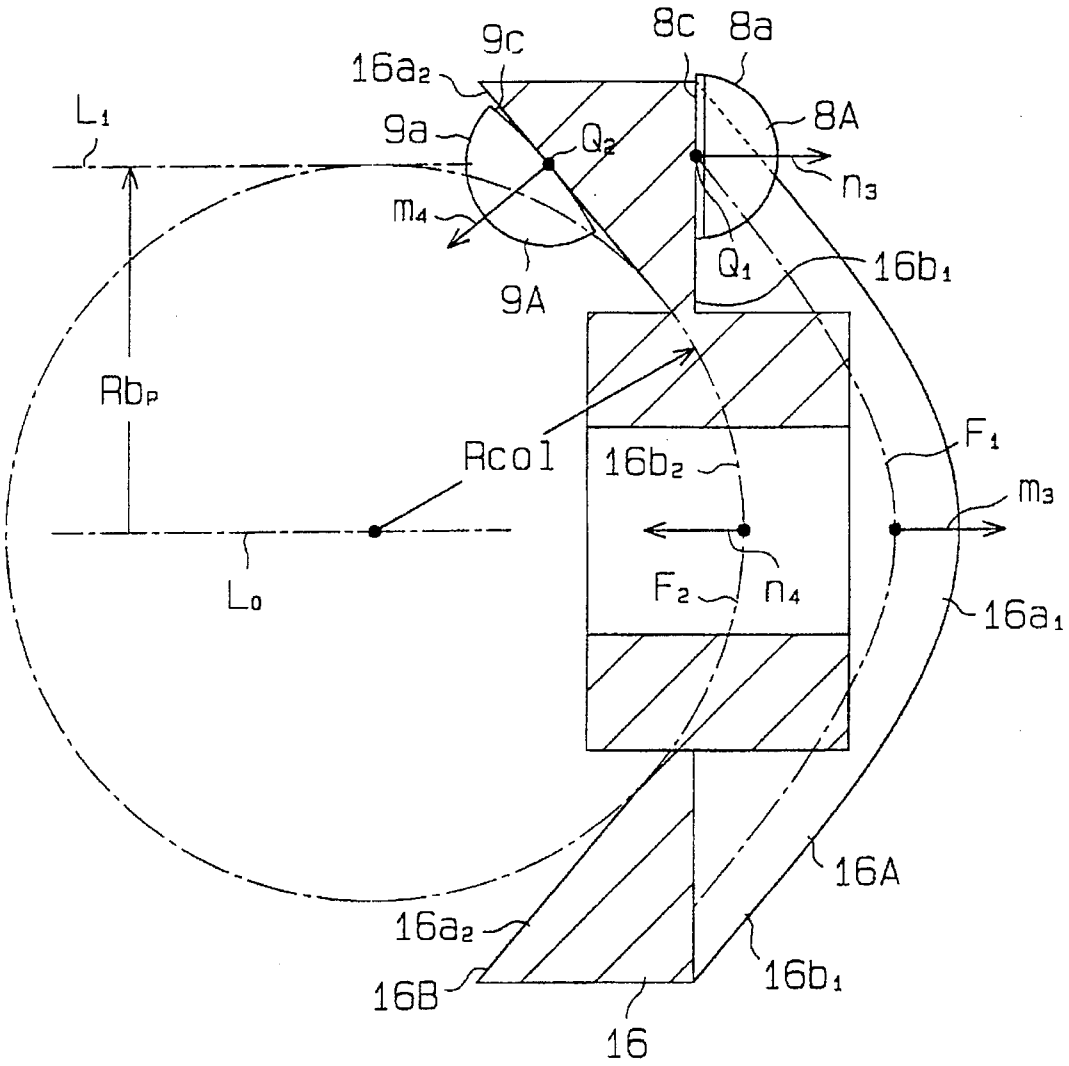
FIG. 10 is a partial cross section illustrating a modification of the cam body.

The present invention is, of course, not limited to the above embodiment. For example, with reference to FIG. 10, another design of a cam body 16 can be utilized. This plate 16 has cam surfaces 16A, 16B respectively including flat surfaces $16a_1$, $16a_2$ and curved surfaces $16b_1$, $16b_2$. Normal vectors $m_3$, $m_4$ representing the force of the shoes 8A, 9A on the flat surfaces $16a_1$, $16a_2$ are directed toward the axis $L_0$ of the cam surfaces 16A, 16B. Normal vectors $n_3$, $n_4$ representing the force of the shoes 8A, 9A on the curved surfaces 16b1, 16b2 are directed parallel to the axis L0. Surface 16B of cam body 16 can be defined with reference to FIG. 5(*b*). An open cylindrical surface P, which corresponds to the surface 16B is defined by the locus of a curved line L when translated in a direction along the z axis in FIG. 5(*b*), or, in a direction perpendicular to the plane of the paper in FIG. 10. A pair of straight lines S shown in FIG. 5(*b*) define the flat surfaces $16a_2$, and the arc between them, which is part of the circle I, defines the surface 16A when the line L is translated in a direction parallel to the plane of the paper in FIG. 10. Thus, plate 16 differs from the cam body 7 in that the curved surfaces are located at the low points of each surface and the flat surfaces are located at the high points of each surface. In this case, the requirement (J) mentioned in the above embodiment is fulfilled. The shoes 8A, 9A include spherical surfaces 8*a*, 9*a* and curved surfaces 8*c*, 9*c*. The curved surfaces 8*c*, 9*c* and the flat surfaces $16b_1$, $16b_2$ are, respectively, kept in planar contact. The curved surfaces 8*c*, 9*c* and the flat surfaces $16a_1$, $16a_2$ are kept in linear contact.

In this embodiment, the curved surfaces $16b_1$, $16b_2$ and the curved surface. 8*c*, 9*c* are, respectively, kept in planar contact for about one half of the rotation of the Plate 16. Accordingly, the Hertz's contact pressure is minimized for half of the time the compressor is in operation. This results in improved durability.

Figure 11:
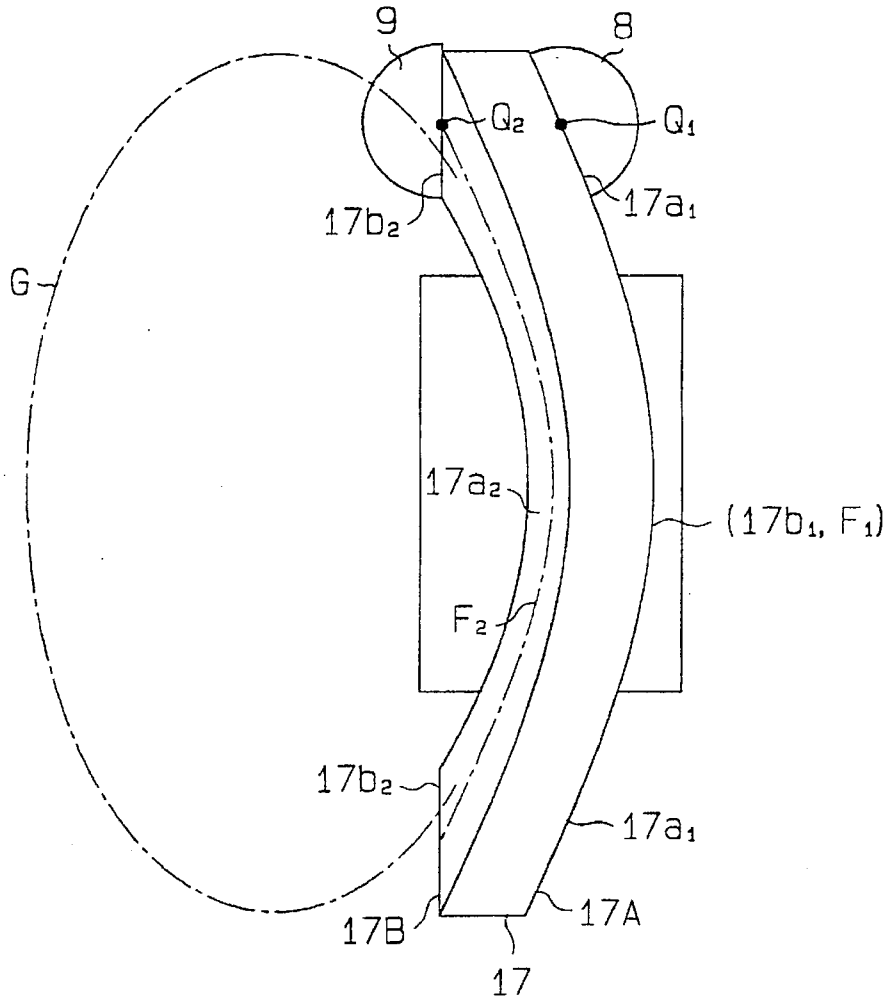
FIG. 11(*a*) is a partial cross section illustrating further modification of the cam body.
Figure 11:
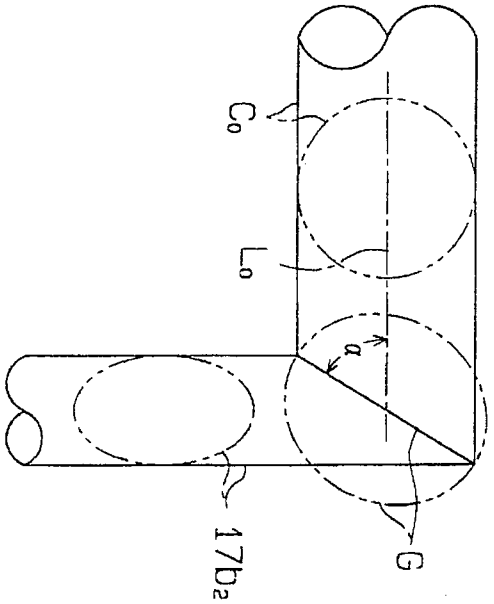

The present invention can also be constituted by a cam body 17 as shown in FIG. 11(*a*), in which cam surfaces 17A, 17B include flat surfaces $17a_1$, $17a_2$ and elliptic curved surfaces $17b_1$, $17b_2$. FIG. 11(*b*) shows the cylindrical surface $C_0$ intersecting with the oval curved surfaces. When the cylindrical surface $C_0$ perpendicularly intersects with the oval curved surfaces $17b_1$, $17b_2$, an intersecting curve G between surface $C_0$ and surfaces $17b_1$, $17b_2$ will be on a plane inclined at the angle $\alpha<45°$ or $45°<\alpha$. This intersecting line is an oval. The movement curves $F_1$, $F_2$ on the cam surfaces 17A, 17B and parts of the intersecting curve G are congruent. The surface of the shoe which slides on the cam body 17 is flat.

Furthermore, in the present invention, it is possible to use a cam body in which the flat surfaces $17a_1$, $17a_2$ have normal vectors directed toward the axis $L_0$. The sliding surfaces of shoes for this plate are curved.

According to the present invention, each cam surface 7A, 7B has a curved surface matching the locus of a predetermined smooth curve of finite length lying in a given plane when translated in a direction perpendicular to the plane. In other words, each cam surface 7A, 7B is in the form of an open cylindrical surface defined by a non-finite directrix. This enables the manufacturing process of the cam body to be simple compared with the conventional process for manufacturing the three dimensional-cam surfaces.

What is claimed is:

1. A wave cam type compressor comprising a wave cam body mounted on a rotary shaft for integral rotation therewith, a piston operably coupled to said cam body by way of a shoe moveable relative to the cam body which shoe follows a predetermined path on a cam surface of said cam body, said piston being disposed for reciprocation in a cylinder bore whereby rotation of the rotary shaft is converted into reciprocating movement of the piston between a top dead center and a bottom dead center in said cylinder bore to compress fluid supplied to the cylinder bore, said cam surface having a contour matching the locus of a predetermined smooth two-dimensional imaginary curve of finite length when said curve is translated from its plane in the direction perpendicular to said plane;

a first portion provided on said cam surface to drive the piston to the bottom dead center; and a second portion provide on said cam surface to drive the piston to the top dead center, said second portion having a larger radius of curvature than said first portion.

2. The compressor as set forth in claim 1, wherein said cam surface includes a flat surface area containing said first portion and a curved surface area containing said second portion.

3. The compressor as set forth in claim 1, wherein said curved surface includes a part of the surface of an imaginary cylinder.

4. The compressor as set forth in claim 1, wherein said shoe has a flat surface slidably contacting the cam surface and a spherical surface for slidably contacting to the piston.

5. The compressor as set forth in claim 1, wherein said cam surface includes a curved surface area containing said first portion and a flat surface area containing said second portion.

6. The compressor as set forth in claim 1, wherein said shoe has a flat surface for slidably contacting the cam surface and a spherical surface for slidably contacting the piston.

7. A wave cam type compressor comprising a wave cam body having a first cam surface and a second cam surface respectively provided on opposite sides of the cam body, said cam body being mounted on a rotary shaft for rotation therewith, said compressor having a plurality of pairs of cylinder bores arranged along an imaginary circle centered about an axis of the rotary shaft, each of said pairs consisting of two axially aligned cylinder bores, a plurality of pistons each having a pair of opposed piston heads respectively accommodated in an associated pair of said aligned cylinder bores, and a plurality of pairs of shoes respectively coupled to the pistons and slidably contacting the cam body, wherein said shoes follow a predetermined path on each cam surface and wherein rotation of the rotary shaft is converted into reciprocating movement of each piston between a top dead center and a bottom dead center in the associated cylinder bores to compress fluid supplied into the cylinder bores, each of said cam surfaces having a contour matching the locus of a predetermined smooth two-dimensional imaginary curve of finite length when said curve is translated from its plane in the direction perpendicular to said plane;

a pair of advancing portions provided on each cam surface to advance the heads of each piston to the top dead center;

a pair of retrieving portions provided on each cam surface to retrieve the heads of each piston to the bottom dead center, said advancing portions having a larger radius of curvature than said retrieving portions; and said predetermined paths are axially aligned and spaced apart an equal axial distance over the entire length of the paths.

8. The compressor as set forth in claim 7, wherein said first cam surface and said second cam surface have an identical contour.

9. The compressor as set forth in claim 8, wherein said first cam surface contour and said second cam surface contour are out of phase one from the other by 90 degrees.

10. The compressor as set forth in claim 7, wherein said pair of advancing portions are separated by 180 degrees of arc one from the other; and said pair of retrieving portions are separated by 180 degrees of arc one from the other, whereby each retrieving portion is separated by 90 degrees of arc from the next advancing portion.

11. The compressor as set forth in claim 10, wherein said cylinder bores each have a longitudinal axis, and all of said cylinder bore axes lie along the surface of an imaginary cylinder concentric with the longitudinal axis of the rotary shaft, and each of said predetermined paths lie on said surface of said imaginary cylinder.

12. The compressor as set forth in claim 11, wherein said advancing portions and said retrieving portions are formed one with a flat surface and the other with a curved surface.

13. The compressor as set forth in claim 11, wherein each of said shoes has a semispherical shape and has a first shoe surface slidably contacting a piston and a second shoe surface slidably contacting an associated cam surface.

14. The compressor as set forth in claim 13, wherein said first and second shoe surfaces are formed one with a flat surface and the other with a curved surface.

15. The compressor as set forth in claim 14, wherein said shoes of an associated pair have centers of curvature spaced from each other by an equal axial distance throughout traversal of their respective paths.

16. A wave cam type compressor comprising a wave cam body having a first cam surface and a second cam surface respectively provided on opposite sides of the cam body, said cam body being mounted on a rotary shaft for rotation therewith, said compressor having a plurality of pairs of cylinder bores arranged along an imaginary circle centered about an axis of the rotary shaft, each of said pairs consisting of two axially aligned cylinder bores, a plurality of pistons each having a pair of opposed piston heads respectively accommodated in an associated pair of said aligned cylinder bores, and a plurality of pairs of shoes respectively coupled to the pistons and adapted to slidably contact the cam body, wherein said shoes follow a predetermined path on each cam surface and wherein rotation of the rotary shaft is converted into reciprocating movement of each piston between a top dead center and a bottom dead center in the associated cylinder bores to compress fluid supplied to the cylinder bores, each of said cam surfaces having a contour matching the locus of a predetermined smooth two-dimensional imaginary curve of finite length when said curve is translated from its plane in the direction perpendicular to said plane; and said first cam surface and said second cam surface both including convex contours which are 90 degrees of arc out of phase one from the other.

17. The compressor as set forth in claim 16, wherein said first cam surface and said second cam surface have identical contours.

18. The compressor as set forth in claim 17, wherein a pair of advancing portions are provided on each path to advance the heads of each piston to the top dead center; and a pair of retrieving portions are provided on each cam surface to retrieve the heads of each piston back to the advancing portions, and said advancing portions have a greater radius of curvature than said retrieving portions.

19. The compressor as set forth in claim 16, wherein said pair of advancing portions are separated by 180 degrees of arc one from the other; and said pair of retrieving portions are separated by 180 degrees of arc one from the other, whereby each retrieving portion is separated by 90 degrees of arc from the next advancing portion.

20. The compressor as set forth in claim 19, wherein said cylinder bores each has a longitudinal axis, and all of said cylinder bore axes lie on the surface of an imaginary cylinder centered about said axis of the rotary shaft, and wherein each of said predetermined paths follow said surface of said imaginary cylinder.

21. The compressor set forth in claim 20, wherein said advancing portions and said retrieving portions are formed one with a flat surface and the other with a curved surface.

22. The compressor as set forth in claim 21, wherein each of said shoes has a semispherical shape and has a first shoe surface slidably contacting the pistons and a second shoe surface slidably contacting the associated cam surface.

23. The compressor as set forth in claim 22, wherein said first and second shoe surfaces are formed one with a flat surface and the other with a curved surface.

24. The compressor as set forth in claim 23, wherein said shoes of an associated pair respectively have centers of curvature spaced apart by an equal axial distance throughout traversal of their paths.

25. A wave cam for a compressor, said wave cam having a wave cam body with a first cam surface and a second cam surface respectively provided on opposite sides of the cam body, said cam body being constructed for mounting on a rotary shaft of said compressor for rotation therewith;

where said compressor has a plurality of pairs of cylinder bores, each of said pairs of cylinder bores consisting of two axially aligned cylinder bores all of which bores have a respective longitudinal axis extending along the surface of an imaginary cylinder with said pairs of cylinder bores being arranged spaced circumferentially about said imaginary cylinder which is centered about an axis of the rotary shaft, a plurality of opposed pistons each having a pair of piston heads respectively accommodated in an associated pair of said aligned cylinder bores, and a plurality of pairs of shoes respectively coupled to the pistons and adapted to slidably contact said cam body and follow predetermined paths on the cam surfaces whereby rotation of the rotary shaft is converted into reciprocating movement of each piston between a top dead center and a bottom dead center in the associated cylinder bores to compress fluid supplied to the cylinder bores;

each of said cam surfaces comprising:

a contour matching a locus of a predetermined smooth two-dimensional imaginary curve of finite length when said curve is translated from its plane in the direction perpendicular to said plane, wherein said predetermined smooth curve has two straight end lines inclining with a predetermined angle and an arc connecting the straight end lines;

an outer peripheral edge defined by a first circle concentric with said imaginary cylinder and of larger diameter than said cylinder;

an inner peripheral edge defined by a second circle concentric with said imaginary cylinder and of smaller diameter than said cylinder;

a pair of advancing portions to advance the heads of each piston to top dead center; and a pair of retrieving portions to retrieve the heads of each piston to bottom dead center;

said advancing portions having a greater radius of curvature than said retrieving portions, and said predetermined paths are axially aligned and spaced apart by an equal axial distance along the entire length of said paths and each of said predetermined paths is located along the surface of said imaginary cylinder.

* * * * *

UNITED STATES PATENT AND TRADEMARK OFFICE

CERTIFICATE OF CORRECTION

PATENT NO. : 5,634,775
DATED : June 3, 1997
INVENTOR(S) : K. Murakami et al.

It is certified that error appears in the above-indentified patent and that said Letters Patent is hereby corrected as shown below:

Abstract, line 3, after "rotation" insert --therewith--;
line 7, after "rotation" delete "therewith";
line 9, change "a lower" to --bottom--.

Column 2, line 21, before "integral" delete "an";
line 62, after "straight" delete "end".

Column 3, line 16, before "along" insert --taken--.

Column 4, line 41, change "straight lines $K_1$" to --straight lines $K_2$--;
line 45, before "four" insert --into--;
line 47, change "normal vector $m_2$" to --normal vector $m_3$--.

UNITED STATES PATENT AND TRADEMARK OFFICE

CERTIFICATE OF CORRECTION

PATENT NO. : 5,634,775

DATED : June 3, 1997

INVENTOR(S) : K. Murakami et al.

it is certified that error appears in the above-indentified patent and that said Letters Patent is hereby corrected as shown below:

Column 6, lines 11, 13 and 15, in the equations, change each occurrence of "$R^2_{col}$" to -- $R_{col}{}^2$ --;
line 11, delete "(4)";
line 15, at the end of the line, following the equation, insert --(4)--.

Column 8, line 12, before "three" delete "the";
line 44 delete "to".

Signed and Sealed this

Sixth Day of October, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,634,775

DATED : June 3, 1997

INVENTOR(S) : Murakami et al.

It is certified that error appears in the above-identified patent and that said Letters Patent is hereby corrected as shown below:

On the title page, Item " [73] Assignee" , correct the name of the Assignee as follows: --Kabushiki Kaisha Toyoda Jidoshokki Seisakusho--.

Signed and Sealed this

Sixteenth Day of March, 1999

*Attest:*

*Attesting Officer*

Q. TODD DICKINSON

*Acting Commissioner of Patents and Trademarks*